US009744652B2

(12) United States Patent
Liao

(10) Patent No.: US 9,744,652 B2
(45) Date of Patent: Aug. 29, 2017

(54) RATCHET WRENCH

(71) Applicant: Jyun-Wun Liao, Taichung (TW)

(72) Inventor: Jyun-Wun Liao, Taichung (TW)

( * ) Notice: Subject to any disclaimer, the term of this patent is extended or adjusted under 35 U.S.C. 154(b) by 196 days.

(21) Appl. No.: 14/817,209

(22) Filed: Aug. 4, 2015

(65) Prior Publication Data

US 2017/0036325 A1 Feb. 9, 2017

(51) Int. Cl.
*B25B 13/46* (2006.01)

(52) U.S. Cl.
CPC ..... *B25B 13/463* (2013.01)

(58) Field of Classification Search
CPC ..... B25B 13/46; B25B 13/463
USPC ..... 81/63.2
See application file for complete search history.

(56) References Cited

U.S. PATENT DOCUMENTS 145,399 A * 12/1873 Colbert ..... B25B 13/466 411/392
6,959,626 B1 * 11/2005 Shen ..... B25B 13/463 81/63
7,114,415 B1 * 10/2006 Chiang ..... B25B 13/463 81/60
7,121,170 B2 * 10/2006 Shen ..... B25B 13/463 81/58
2002/0166417 A1 * 11/2002 Hu ..... B25B 23/0035 81/63.2
2016/0129564 A1 * 5/2016 Chen ..... B25B 13/463 81/63.2
2016/0375561 A1 * 12/2016 Chen ..... B25B 13/463 81/63.2

* cited by examiner

*Primary Examiner* — Hadi Shakeri

(57) ABSTRACT

A ratchet wrench includes a head which has a through hole, a first recess, a second recess and a closed portion. A ratchet member is located in the through hole and is engaged with a pawl in the first recess. The control unit is located in the second recess and has a control member, an engaging member and a resilient member. The control member has a cylindrical rod with a slot and a notch. The engaging member is located in the slot and has a receiving recess, two contact areas and a recessed section. The resilient member is located in the notch and the receiving recess. The engaging member is restricted by the closed portion and biased by engaging member which restricts the cylindrical rod so that the control member is rotatably located in the second recess to push the engaging member to move the pawl.

5 Claims, 9 Drawing Sheets

B-B

C-C

RATCHET WRENCH

BACKGROUND OF THE INVENTION

1. Fields of the Invention

The present invention relates to a ratchet wrench, and more particularly, to a ratchet wrench whose pawl is restricted within the recess and a closed portion of the recess, and the control unit is easily manufactured.

2. Descriptions of Related Art

The conventional ratchet wrench is disclosed in U.S. Pat. No. 7,121,170 and comprises a handle; a drive head mounted on an end of the handle and having a first end formed with a receiving hole, a mediate portion formed with a receiving recess communicating with the receiving hole, and a second end formed with a receiving chamber communicating with the receiving recess; a ratchet wheel mounted in the receiving hole of the drive head; a pawl member pivotally mounted in the receiving recess of the drive head and engaged with the ratchet wheel; a control knob rotatably mounted in the receiving chamber of the drive head and having an inside formed with a passage radially extended through the control knob; a positioning plate mounted in the passage of the control knob and having a first end rested on the pawl member to push the pawl member to press the ratchet wheel; and an urging spring mounted on a second end of the positioning plate and urged between the positioning plate and the drive head. However, the control knob has a passage, a snap groove and a resting plate, so that when manufacturing, only the method of powder extruding or powder injection. The shape of the control knob is limited by the passage, the snap groove and the resting plate, so that the molding set can only be arranged a front mold and a rear mold. The molding set cannot be a top mold and a bottom mold, so that the manufacturing cost is high, and the method for making the control knob is restricted. The snap groove is located at the bottom of the control knob so as to receive the limit spring therein so that the control knob can be installed in the receiving chamber of the handle. This involves a cost of the limit spring.

The present invention intends to provide a ratchet wrench to eliminate the shortcomings mentioned above.

SUMMARY OF THE INVENTION

The present invention relates to a ratchet wrench and comprises a head, a ratchet member, a pawl and a control unit. The head has a through hole, a first recess, a second recess and a closed portion. The ratchet member is located in the through hole and has teeth, a disk, a first groove and a circular hole. The pawl is located in the first recess and has teeth for being engaged with the teeth of the ratchet member, and a recessed area.

The control unit is located in the second recess and has a control member, an engaging member and a resilient member. The control member has a cylindrical rod with a slot and a notch. The engaging member is located in the slot and has a receiving recess, two contact areas and a recessed section. The resilient member is located in the notch and the receiving recess. The engaging member is restricted by the closed portion and biased by engaging member which restricts the cylindrical rod so that the control member is rotatably located in the second recess. The cover seals the first and second recesses. The disk contacts the bottom of the head, the clip engaged with the first groove and contacts the cover.

The engaging member is stably positioned by the closed portion and located in the slot of the control member so as to drive the pawl to desired position.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
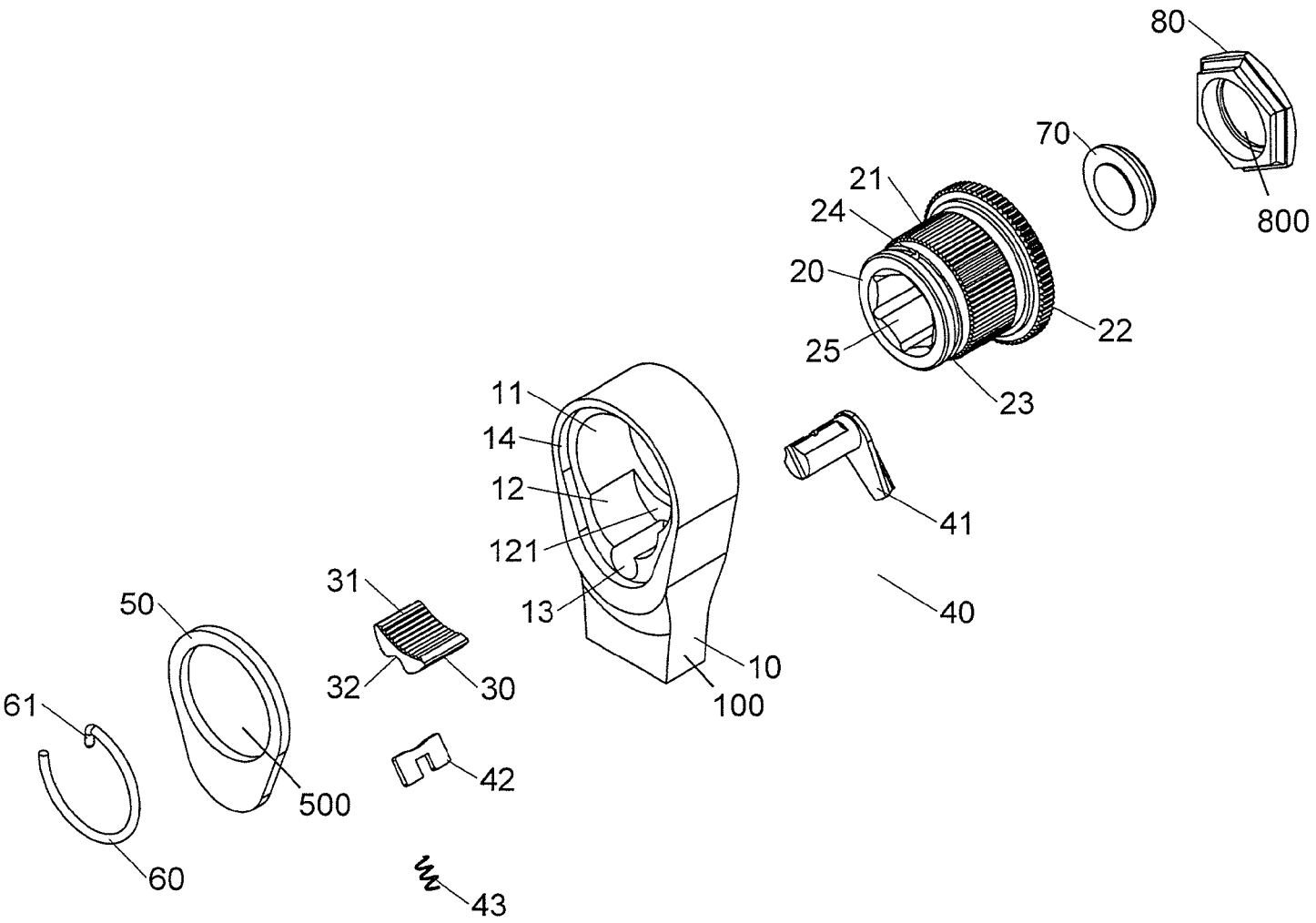
FIG. 1 is an exploded view of the ratchet wrench of the present invention.
Figure 5:
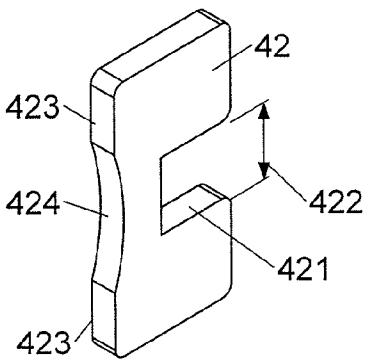
FIG. 5 shows the engaging member of the ratchet wrench of the present invention.
Figure 4:
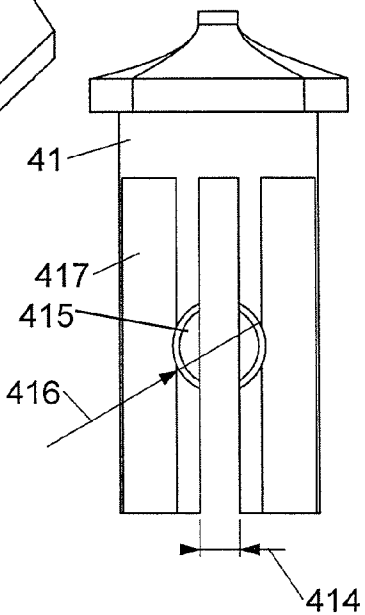
FIG. 4 is a front view of the control member of the ratchet wrench of the present invention.
Figure 3:
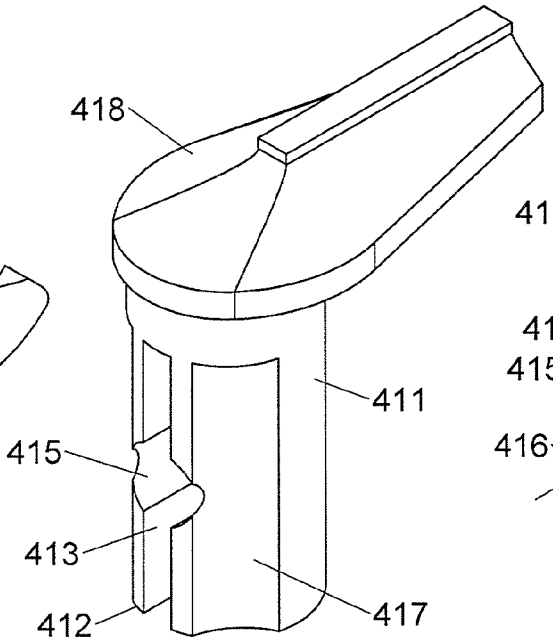
FIG. 3 is a perspective view to show the control member of the ratchet wrench of the present invention.
Figure 2:
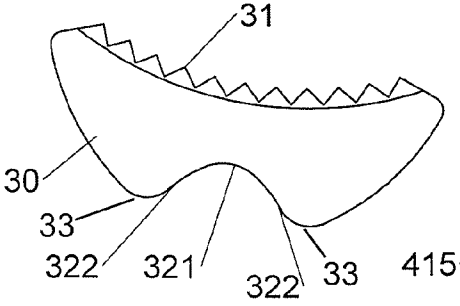
FIG. 2 is a top view of the pawl of the ratchet wrench of the present invention.
Figure 6:
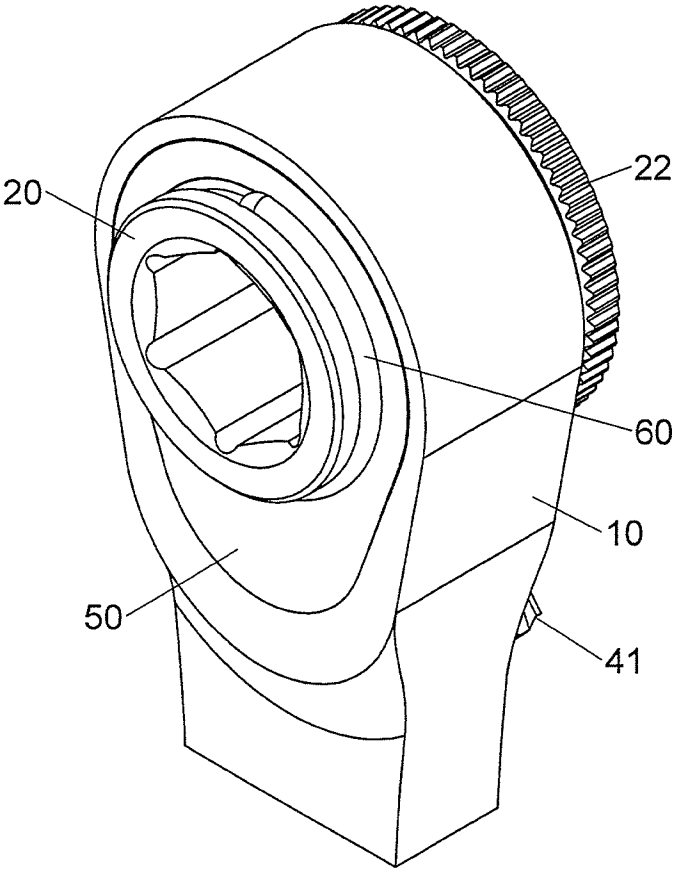
FIG. 6 is a perspective view to show the ratchet wrench of the present invention.

Referring to FIGS. 1 to 11, the ratchet wrench of the present invention comprises a head 10 having a through hole 11 defined through the top and the bottom thereof. The head 10 integrally form at one end of a handle 100. A first recess 12 is defined in the inner periphery of the through hole 11, and the center of the first recess 12 is located within the through hole. The diameter of the first recess 12 is smaller than that of the through hole 11. The first recess 12 includes a closed portion 121 formed at the bottom of the head 10. A second recess 13 is defined in the inner periphery of the first recess 12 and has at least one open end. The diameter of the second recess 13 is smaller than that of the first recess 12. The head 10 has a recessed area 14 defined along the through hole 11, the first recess 12 and the second recess 13.

A ratchet member 20 is rotatably located in the through hole 11 and has first teeth 21 defined in the outside thereof. A first groove 23 is defined in the first end of the ratchet member 20 and an enlarged disk 22 is formed on the second end of the ratchet member 20. The disk 22 is exposed from the head 10 and contacts the bottom of the head 10. A circular hole 24 is defined through the inner periphery of the first groove 23. The first groove 23 and the hole 24 are exposed from the top of the head 10. The ratchet member 20 has a non-circular mounting portion 25 with which the first groove 23 and the circular hole 24 communicate. The mounting portion 25 can be a hexagonal through hole or a bi-hexagonal through hole.

A pawl 30 is movably located in the first recess 12. The pawl 30 has second teeth 31 defined in the front side thereof and a recessed portion 32 is defined in the rear side thereof. The second teeth 31 are engaged with the first teeth 21. The recessed portion 32 has a first curved face 321 and two second curved face 322 which are located symmetrically on two ends of the first curved face 321.

A control unit 40 is located in the second recess 13 so as to control the movement of the pawl 30 in the first recess 12 and a rotational direction of the ratchet member 20. The control unit 40 has a control member 41, an engaging member 42 and a resilient member 43. The control member 41 has a cylindrical rod 411 which is rotatably located in the second recess 13. A slot 413 is defined axially in the distal end thereof, and the slot 413 is radially defined through the cylindrical rod 411. A circular notch 415 is defined in the outer periphery of the cylindrical rod 411 and communicates with the slot 413. The diameter 416 of the notch 415 is larger than the width 414 of the slot 413. Two curved areas 417 are defined in the outer periphery of the cylindrical rod 411 and separated by the slot 413. The two curved areas 417 are located symmetrically relative to the slot 413. The control member 41 has a lever 418 which extends beyond the second recess 13. The engaging member 42 is engaged with the slot 413 and has the length as the slot 413. The engaging member 42 has a receiving recess 421 defined centrally in the rear side thereof so as to form a U-shaped rear side. A gap 422 between two sidewalls of the receiving recess 421 is the same of the diameter 416 of the notch 415.

The engaging member 42 has two contact areas 423 and a recessed section 424 formed on the front side thereof, the recessed section 424 is located between the two contact areas 423. The resilient member 43 is located in the receiving recess 421 and the notch 415. The diameter of the resilient member 43 is the same as that of the diameter 416 of the notch 415. The two contact areas 423 contact one of the second curved faces 322 by the resilient member 43. The radius of each of the second curved faces 322 is preferably close to that of the contact area 423. The recessed section 424 reduces the contact area between the engaging member 42 and the second curved faces 322.

Figure 7:
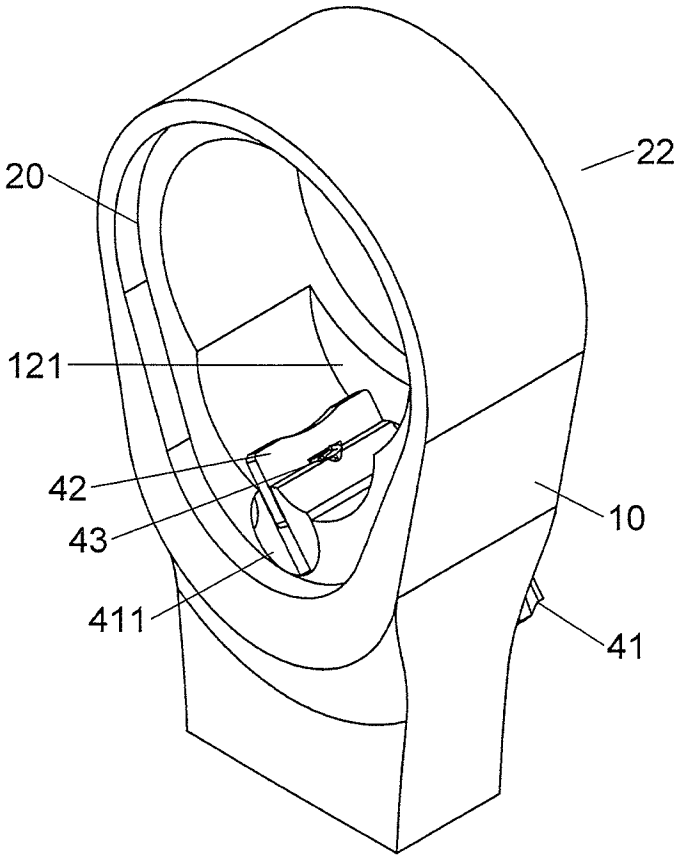
FIG. 7 is a perspective view to show the ratchet wrench of the present invention, wherein the ratchet member and the pawl are not yet installed.
Figure 9:
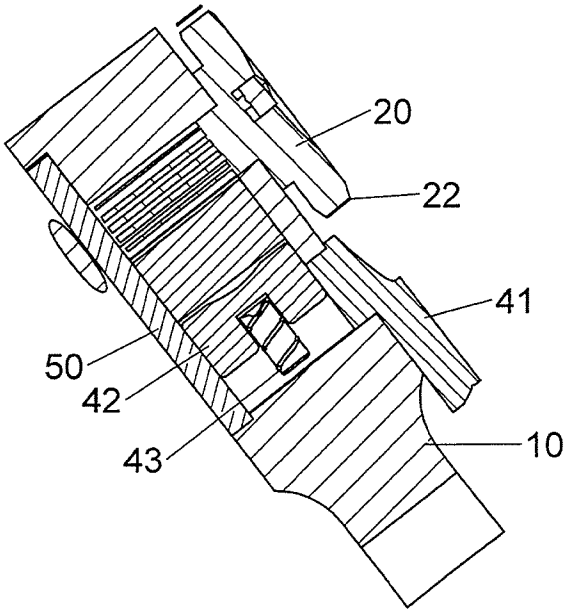
FIG. 9 is a cross sectional view, taken along line B-B of FIG. 8.
Figure 8:
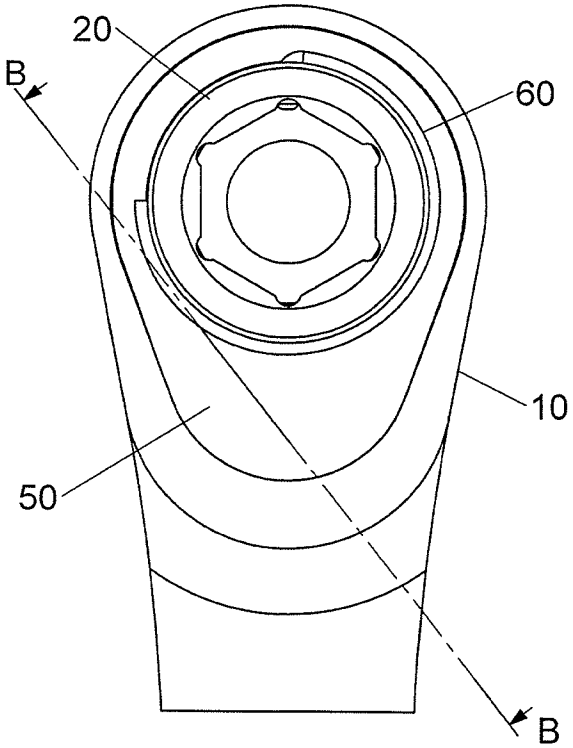
FIG. 8 is a top view of the ratchet wrench of the present invention.
Figure 11:
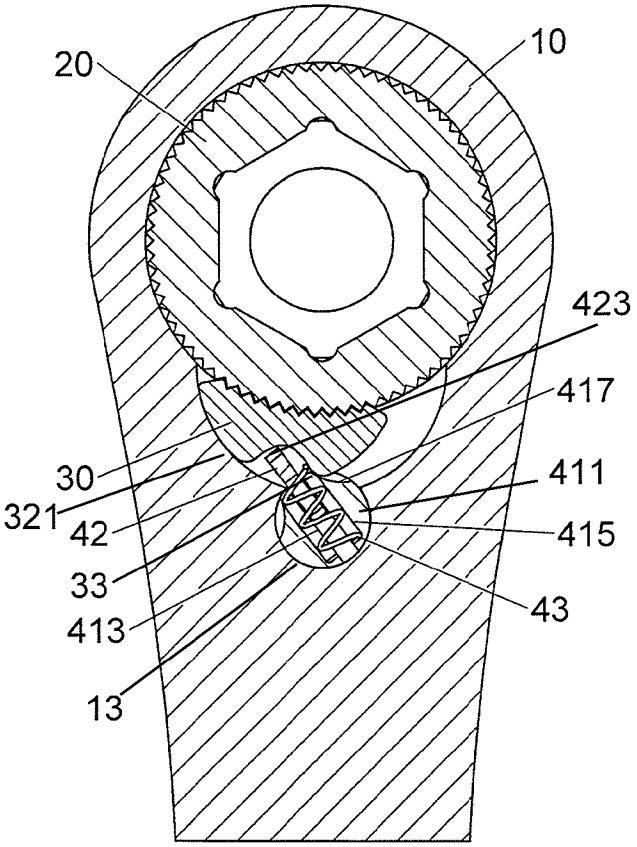
FIG. 11 is a cross sectional view, taken along line C-C of FIG. 10.
Figure 10:
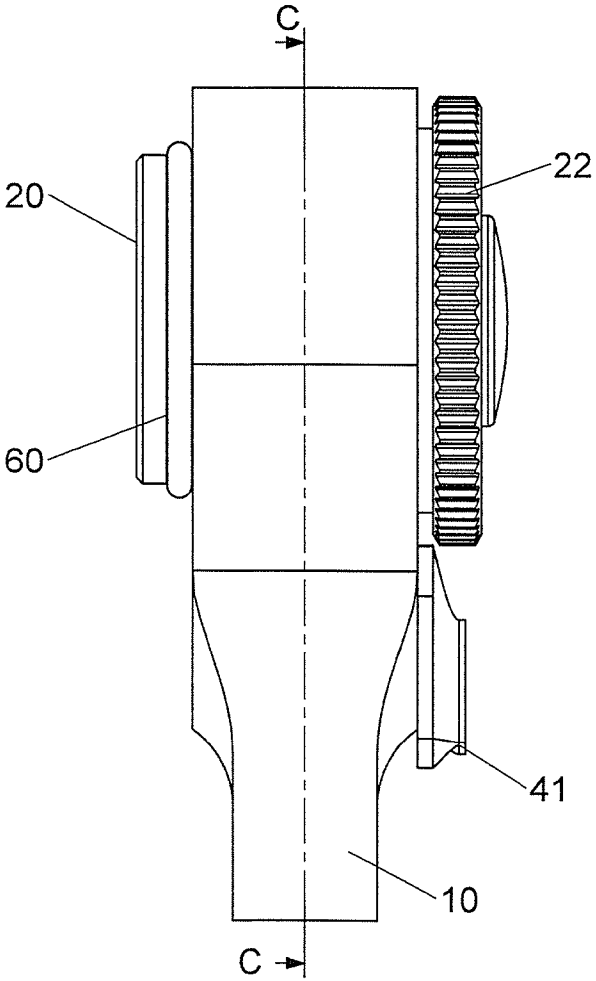
FIG. 10 is a side view of the ratchet wrench of the present invention.

A cover 50 covers the first and second recesses 12, 13. The cover 50 has a hole 500 through which the first end of the ratchet member 20 extends. The cover 50 is engaged with the recessed area 14 by engaging a clip 60 with the first groove 23. The clip 60 is exposed beyond the head 10 and contacts the top of the cover 50. The clip 60 has a hook 61 extending inward from one of two ends thereof. The hook 61 extends through the circular hole 24 of the ratchet member 20 and reaches into the mounting portion 25. The ratchet member 20 is restricted by the disk 22 and the clip 60 so as to be engaged with the through hole 11. An end piece 70 seals one open end of the mounting portion 25. A locking ring 80 is connected to one end of the mounting portion 25 and has a central through hole 800 with which the end piece 70 is engaged to seal the mounting portion 25. As shown in FIGS. 7 and 11, the first end of the engaging member 42 contacts the closed portion 121 which restricts the engaging member 42. The engaging member 42 restricts the resilient member 43 which restricts the cylindrical rod 411 so that the control member 41 is not disengaged from the second recess 13. The contact areas 423 contact one of the second curved faces 321 to engage the teeth 31 of the pawl 30 with the teeth 21 of the ratchet member 20. The head 10 is rotated to drive the ratchet member 20 by the pawl 30, the head 10 is slightly deformed to allow one of the two protrusions 33 at two sides of the recessed area 32 to contact curved area 417.

Figure 13:
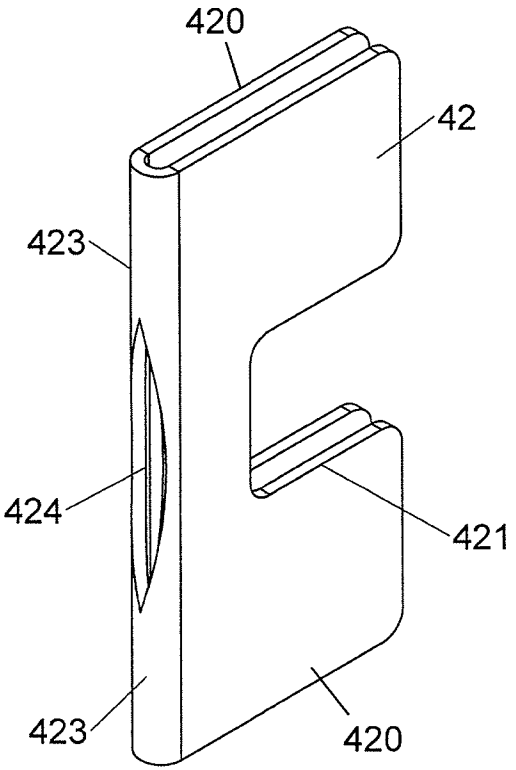
FIG. 13 shows that the engaging member of the second embodiment of the ratchet wrench of the present invention is folded.
Figure 12:
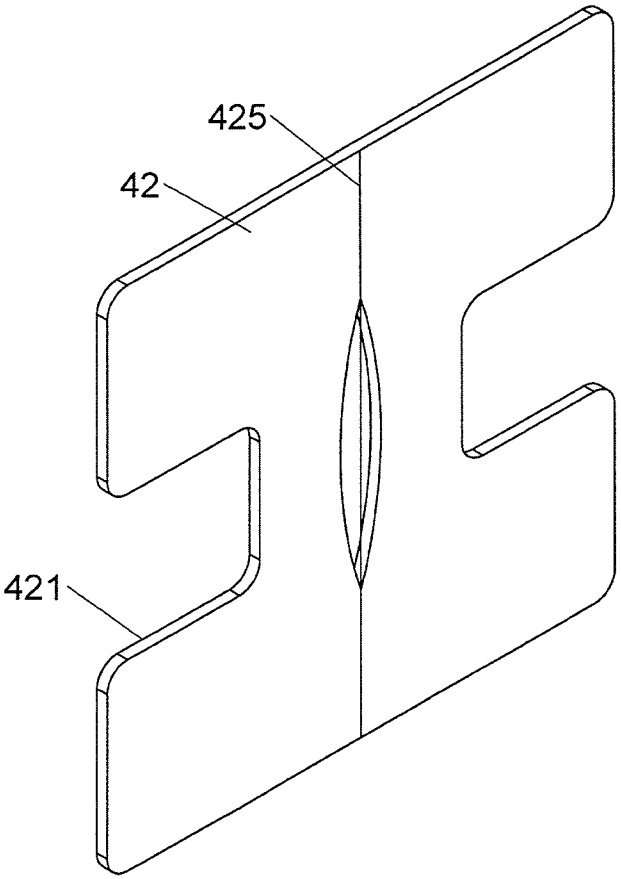
FIG. 12 shows that the engaging member of the second embodiment of the ratchet wrench of the present invention is not yet folded.

FIGS. 12 and 13 show that the engaging member 42 is a metal plate which has a folding line 425. The metal plate is folded along the folding line 425 so as to form two plates 420 which are spaced apart from each other. The two contact areas 423 each have a curved outer surface.

Figure 14:
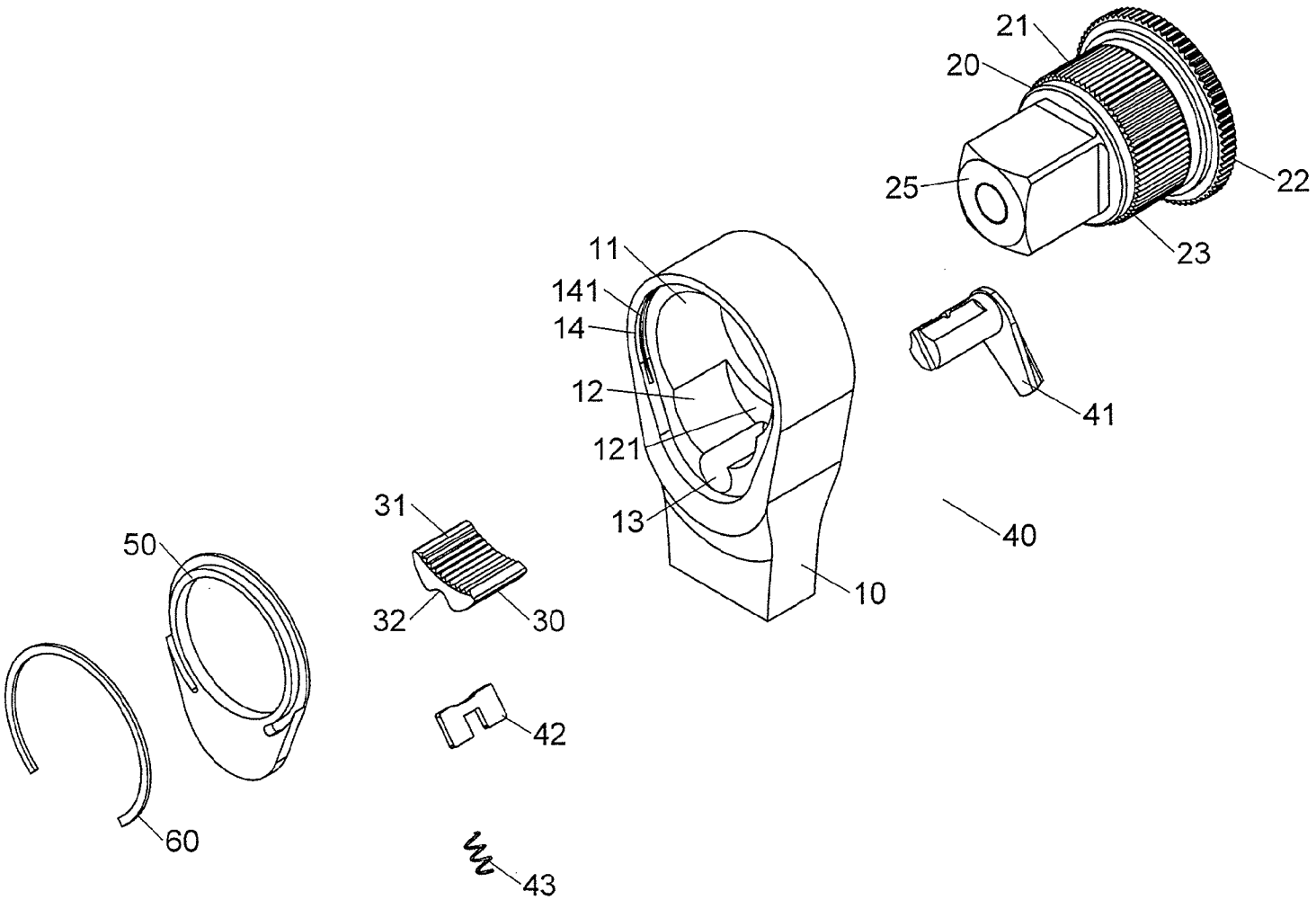
FIG. 14 is an exploded view of the third embodiment of the ratchet wrench of the present invention.

FIG. 14 shows that the mounting portion 25 is a rectangular protrusion and the recessed area 14 has a second groove 141 defined in the inner periphery thereof, and the clip 60 is engaged with the second groove 141.

Figure 15:
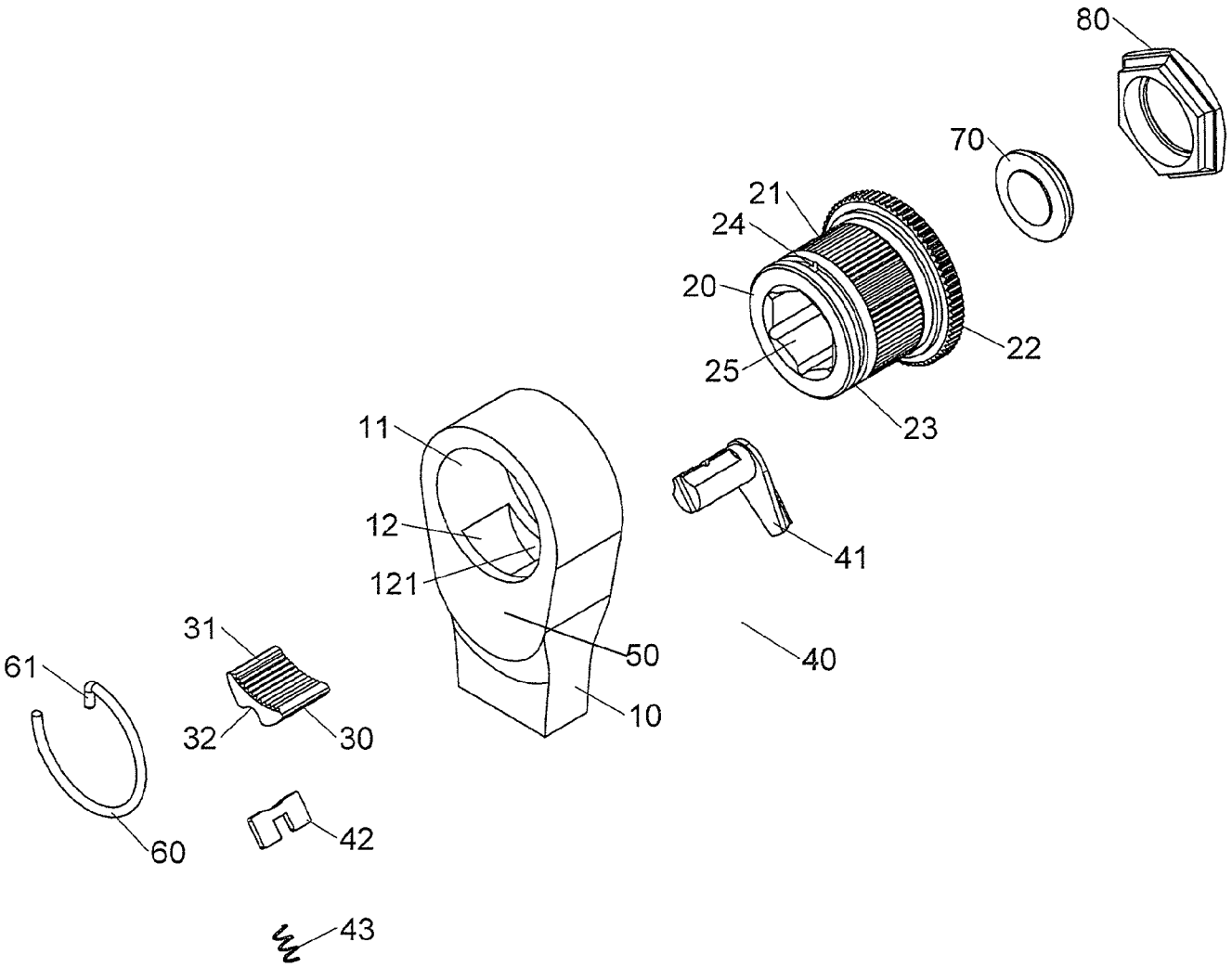
FIG. 15 is an exploded view of the fourth embodiment of the ratchet wrench of the present invention.

FIG. 15 shows that the head 10 and the cover 50 are integrally formed as a one piece.

The present invention has the following advantages which are that the first end of the engaging member 42 contacts the closed portion 121 which restricts the engaging member 42. The engaging member 42 restricts the resilient member 43 which restricts the cylindrical rod 411 so that the control member 41 is not disengaged from the second recess 13.

The slot 413 opens to three directions. The control member 41 can be made by power extruding or powder injection, and the molding set for the control member 41 can be the combination of a top mold and a bottom mold, or a front mold and a rear mold. The control member 41 can easily make the slot 413 and the notch 415.

The contact areas 423 are biased by the resilient member 43 to contact one of the second curved faces 321 to engage the teeth 31 of the pawl 30 with the teeth 21 of the ratchet member 20. The recessed portion 32 includes a first curved face 321 and two second curved faces 322. The radius of each of the second curved faces 322 is close to that of the contact area 423 to let the engaging member 42 more smoothly drive the pawl 30 in the first recess 12.

The recessed section 424 reduces the contact area between the engaging member 42 and the second curved faces 322, so that the engaging member 42 can smoothly drive the pawl 30 in the first recess 12.

The engaging member 42 is a metal plate and is folded along the folding line 425 so as to form two plates 420 which are spaced apart from each other. The front side of the two plates 420 are connected to each other, and the two contact areas 423 each have a curved outer surface.

While we have shown and described the embodiment in accordance with the present invention, it should be clear to those skilled in the art that further embodiments may be made without departing from the scope of the present invention.

What is claimed is:

1. A ratchet wrench comprising:

a head having a through hole defined through a top and a bottom thereof, a first recess defined in an inner periphery of the through hole, a center of the first recess being located within the through hole, the first recess including a closed portion formed at the bottom of the head, a second recess defined in an inner periphery of the first recess and having at least one open end;

a ratchet member rotatably located in the through hole and having first teeth defined in an outside thereof, a first groove defined in a first end of the ratchet member and an enlarged disk formed on a second end of the ratchet member, the disk exposed from the head and contacting the bottom of the head, a circular hole defined through an inner periphery of the first groove, the first groove and the hole being exposed from the top of the head, the ratchet member having a non-circular mounting portion with which the first groove and the circular hole communicate;

a pawl movably located in the first recess, the pawl having second teeth defined in a front side thereof and a recessed portion defined in a rear side thereof, the second teeth engaged with the first teeth, the recessed portion having a first curved face and two second curved face which are located symmetrically on two ends of the first curved face;

a control unit located in the second recess so as to control a movement of the pawl in the first recess and a rotational direction of the ratchet member, the control unit having a control member, an engaging member and a resilient member, the control member having a cylindrical rod which is rotatably located in the second recess, a slot defined axially in a distal end thereof, the slot radially defined through the cylindrical rod, a notch defined in an outer periphery of the cylindrical rod and communicating with the slot, a diameter of the notch being larger than a width of the slot, two curved areas defined in the outer periphery of the cylindrical rod and separated by the slot, the two curved areas located symmetrically relative to the slot, the control member having a lever which extends beyond the second recess, the engaging member engaged with the slot and having a length the same as that of the slot, the engaging member having a receiving recess defined centrally in a rear side thereof, a gap between two sidewalls of the receiving recess being the same of the diameter of the notch, the engaging member having two contact areas and a recessed section on a front side thereof, the recessed section located between the two contact areas, the resilient member located in the receiving recess and the notch, a diameter of the resilient member being the same as that of the diameter of the notch, a first end of the engaging member contacting the closed portion which restricts the engaging member, the engaging member restricting the resilient member which restricts the cylindrical rod so that the control member is not disengaged from the second recess, when the control member rotates, the engaging member moves the pawl in the first recess, when the two contact areas are biased by the resilient member and contact the one of the second curved faces, the second teeth of the pawl are engaged with the first teeth of the ratchet member, the rear side of the pawl is engaged with one of the curved areas;

a cover covering the first and second recesses, the cover having a hole through which the first end of the ratchet member extends;

a clip engaged with the head and exposed beyond the head and contacting the cover, the clip having a hook extending inward from one of two ends thereof, the hook extending through the circular hole of the ratchet member and reaching into the mounting portion;

an end piece sealing the mounting portion, and a locking ring connected to one end of the mounting portion and having a hole with which the end piece is engaged to seal the mounting portion.

2. The ratchet wrench as claimed in claim 1, wherein the engaging member is a metal plate which has a folding line, the metal plate is folded along the folding line so as to form two plates which are spaced apart from each other, the two contact areas each have a curved outer surface.

3. The ratchet wrench as claimed in claim 1, wherein the head has a recessed area defined along the through hole, the first recess and the second recess, the cover is engaged with the recessed area by the clip.

4. The ratchet wrench as claimed in claim 1, wherein the mounting portion is a hexagonal through hole or a bi-hexagonal through hole.

5. The ratchet wrench as claimed in claim 1, wherein the head and the cover are integrally formed as a one piece.

* * * * *